US005205268A

United States Patent [19]

Savage

[11] Patent Number: 5,205,268

[45] Date of Patent: Apr. 27, 1993

[54] ARCHERY APPARATUS

[75] Inventor: Huey P. Savage, Lake Forest, Calif.

[73] Assignee: Savage Systems, Inc., San Clemente, Calif.

[21] Appl. No.: 705,299

[22] Filed: May 24, 1991

[51] Int. Cl.[5] ..... F41B 5/00

[52] U.S. Cl. ..... 124/24.1; 124/25.6; 124/35.2; 124/44.5; 124/87; 124/88

[58] Field of Search ..... 124/23.1, 24.1, 25.6, 124/35.2, 86, 87, 88, 89, 44.5, 32, 35.1; 33/265

[56] References Cited

U.S. PATENT DOCUMENTS

| | | | |
|---|---|---|---|
| D. 198,087 | 4/1964 | Dixon | D22/107 |
| 2,344,799 | 3/1944 | Brown et al. | 124/23.1 |
| 2,714,884 | 8/1955 | Ickes | 124/23.1 |
| 2,900,973 | 8/1959 | Diehr | 124/23.1 |
| 2,975,780 | 3/1961 | Fisher | 124/24.1 |
| 3,171,397 | 3/1965 | Daly | 124/88 X |
| 3,504,659 | 4/1970 | Babington | 124/24.1 |
| 3,517,657 | 6/1970 | Alban | 124/86 |
| 3,666,368 | 5/1972 | Sprandel | 356/21 |
| 3,670,422 | 6/1972 | Stebbins et al. | 33/265 |
| 3,859,733 | 1/1975 | Chesnick | 33/265 |
| 4,407,261 | 10/1983 | Elliot | 124/44.5 |
| 4,418,479 | 12/1983 | Stachnik | 33/265 |
| 4,509,497 | 4/1985 | Garvison | 124/35.2 |
| 4,662,344 | 5/1987 | Mitchell | 124/22 |
| 4,674,469 | 6/1987 | Peck | 124/32 X |
| 4,685,217 | 8/1987 | Shader | 33/265 |
| 4,787,361 | 11/1988 | Vyprachticky | 124/88 |
| 4,803,971 | 2/1989 | Fletcher | 124/24.1 X |
| 4,831,997 | 5/1989 | Greene | 124/35.2 |
| 4,865,008 | 9/1989 | Troncoso | 124/44.5 |
| 4,915,088 | 4/1990 | Powers | 124/87 |
| 4,967,478 | 11/1990 | Sherman | 33/265 |
| 4,982,503 | 1/1991 | Land | 33/265 |
| 5,022,378 | 6/1991 | Rhodehouse et al. | 124/44.5 |
| 5,025,565 | 6/1991 | Stenerson et al. | 124/87 |
| 5,040,301 | 8/1991 | Forbis | 124/87 X |
| 5,113,841 | 5/1992 | Bratcher | 124/23.1 |
| 5,140,972 | 8/1992 | Fisk | 124/44.5 |

OTHER PUBLICATIONS

"Tie The Loop" Article in Bow & Arrow Magazine, pp. 46–47, Apr. 1986.

Bow & Arrow Oct., 1985 p. 69—Advertisement by The Market Place.

*Primary Examiner*—Peter M. Cuomo
*Assistant Examiner*—Jeffrey L. Thompson
*Attorney, Agent, or Firm*—Harold L. Jackson

[57] ABSTRACT

An archery apparatus for optimizing the force exerted on the arrow upon release includes a frame or riser and a pair of resilient limbs extending in opposite directions therefrom. A bowstring is connected between the free ends of the limbs and includes a nocking point for engagement with the nock of an arrow. an arrow rest is carried by the frame and together with the nocking point on the bowstring define a shooting axis along with the arrow travels when departing the bow. A hand grip is mounted on each side of the frame adjacent the shooting axis for accommodating the left and right hands of an archer. A harness adapted to be worn by the archer includes a bowstring release mechanism for selectively holding and releasing the bowstring adjacent the nocking point. In operation, the archer after putting the harness on, (1) secures the bowstring to the bowstring release mechanism and flexes the bow limbs by forcing the frame away from his or her body with both arms, (2) aims the arrow toward a desired target and (3) actuates the bowstring release mechanism to propel the arrow toward the target.

38 Claims, 5 Drawing Sheets

ARCHERY APPARATUS

BACKGROUND OF THE INVENTION

1. Field of the Invention

The present invention relates to archery equipment in which the force to be imparted to an arrow is held by the archer and more particularly to a bow and bowstring release mechanism which optimize the force exerted on the arrow upon release.

2. Description of the Prior Art

Bow designers have from ancient times sought to increase the speed at which an arrow is launched thereby improving the trajectory, range and destructive power of the arrow.

The efforts of the designers have resulted in a progression of bows from the conventional long bow to the recurved bow and, in more recent times, to the compound bow. To shoot an arrow each bow must be held at arms length with one hand while the other hand and arm pulls the bowstring from its resting position to its full draw position. The force exerted on the bowstring by the archer is commonly referred to as the draw weight. Once the bowstring is in the full draw position, the bow must be held in a steady position while the arrow is aimed at a desired target and then released. The limiting factor on draw weight is the strength of the archer's back muscles and particularly the strength of the back muscles associated with the pulling arm.

The compound bow utilizes eccentric wheels or pulleys mounted on the ends of the bow limbs and a pair of cables in addition to the bowstring connected between the wheels to increase the stored energy (and exit velocity) imparted to an arrow over that available with a recurved bow. The compound bow accomplishes this by providing a peak draw weight intermediate the resting and full draw positions and a lower draw weight at the full draw position to increase steadiness while aiming and maximizing the total stored energy stored in the bow limbs. The difference between the peak draw weight and the full draw weight in percent is commonly referred to as let-off. As the let-off increases the full draw weight decreases as compared to the peak draw weight and visa versa. A compound bow with a let-off of say 40–50%, at full draw, may increase the exit velocity of an arrow from the bow by as much as 40% over a recurved bow having the same draw weight at the full draw position. However, the strength of the archer's back muscles associated with the pulling arm still limits the total draw weight which can be designed into the bow.

To accurately shoot an arrow it is necessary to provide a rest (or launcher) for the front of the arrow and a nocking point for the rear of the arrow near the middle of the string. The arrow rest and nocking point define the axis along which the arrow is accelerated from the bow (i.e. shooting axis). Conventional bows carry an arrow rest near the hand grip on the riser or central section. Such rests commonly contact the vanes, feathers or fletches (hereinafter "vanes") affixed to the rear of the arrow and may deflect the arrow either laterally (i.e. out of the true plane of movement of the bowstring) or vertically (i.e. up or down) or both. Since such deflections are inconsistent and unpredictable it is difficult for the archer to make allowances therefore.

The position of the arrow rest on the bow's central section and the draw length of the bow determines the minimum length of the arrow suitable for use with the bow. To shoot shorter (and stiffer) arrows it is necessary to position the arrow rest closer to the bowstring. However, the placement of the arrow rest must accommodate the movement of the bowstring to its post release position (i.e. beyond its resting position toward the central section) after the arrow has been released to prevent the bowstring from striking the arrow rest. This post release movement, which may amount to several inches, adds to the minimum length of an arrow suitable for use with any given bow.

Another problem encountered with conventional bows concerns the accurate alignment of the central bow section and its attendant arrow rest within the plane of the movement of the bowstring. To take the forearm of the arm holding the bow out of the path of the bowstring, it is necessary for the archer to roll or bend the arm and/or wrist. This creates a sideways moment or torque that tends to twist the central section of the bow and the arrow rest out of the plane of the moving bowstring. Many bows have a peep sights affixed to the bowstring and a bowsight with a vertical cross-hair (and horizontal range lines) affixed to the central section. However, the alignment of the peep sight with the vertical cross-hair and the target does not inform the archer that the central section is precisely aligned with the plane of movement of the bowstring. Some skilled archers may be able to compensate for such misalignment (most of the time) by aiming slightly to one side or the other of the desired target while holding the bow so that their forearms are in exactly the same position each time. Others try to shoot with the bow hand open to avoid torque. However, most archers cannot accomplish these feats consistently. This torque factor simply increases the skill level required to place arrows within a desired target at any given range.

Various approaches have been taken in the past to alleviate some of the above problems. To increase an arrow's exit velocity, compound bows have been constructed with increased peak draw weights and let-offs of the order of 30% or less. However, such bows are difficult to hold steady during the aiming process. Even with such decreased let-offs the strength of the archer's back muscles associated with the pulling arm remains the limiting factor on maximum draw weight and energy stored in the limbs.

The arrow rest/vane contact problem has been addressed primarily by building flexibility into the rest so that the portion of the rest in contact with the arrow will move out of the arrow's path (i.e., bend or rotate against a spring) when contacted by the vanes. In each case there is inherently some contact between the vanes and the arrow rest which causes some unwanted deflection of the arrow. See, for example, the arrow rests illustrated on pages 33–35 of the Spring 1988 edition of the Bowhunters Discount Warehouse Inc's catalogue of Wellsville, Pa. The flexibility built into conventional rests is also needed to accommodate flexing of the arrow shaft during acceleration (i.e. arrow paradox).

Another prior approach to the arrow rest/vane contact problem involves the use of a mechanism which attempts to sense the shock to the bow when the bowstring is released to move the arrow rest out of the way. However, this type of mechanism has proven unreliable in retracting the arrow rest at the proper time if at all. If the arrow rest is retracted too soon, the force of gravity will cause the front of the arrow to drop during the acceleration phase and change the desired shooting axis.

Various prior art patents have proposed solutions to some of the above problems. For example, U.S. Pat. No. 3,517,657 describes a sling shot type bow in which a rigid member such as a rod extends between a hand held central member and the bowstring in its full draw position. The archer can hold the remote end of the rod and an arrow release mechanism in the cocking hand to thereby relieve tension on the extended or aiming arm. This type of bow (similar to a cross-bow in operation) while perhaps relieving some pressure on the user's arms would not be tolerated in archery tournaments or by hunting regulations which require that the drawstring force be held by the archer. Furthermore, the maximum draw weight for such a bow is still limited by the strength of the archer's back muscles associated with the pulling arm. A device similar to that shown in the '657 patent (referred to as a vertically oriented crossbow) is described in U.S. Pat. No. 2,714,884. Another device for modifying a conventional bow so that it will shoot like a crossbow has been advertised by The Market Place of Freemont, Wis. on page 69 of the October, 1985 issue of Bow and Arrow.

U.S. Pat. Nos. 2,344,799 and 4,662,344 describe bows which use elastic bowstrings to propel the arrow. U.S. Pat. No. 4,787,361 describes a combination handgrip and forearm protector for bows for reducing the tendency of the bow to twist when the arrow is released. However, there is nothing in the described apparatus which allows the user to determine whether or not the central section of the bow and the arrow rest carried hereby is in fact twisted out of alignment.

U.S. Pat. No. 4,674,469 describes a bowstring release to be held in the hand of the pulling arm. A solenoid actuated by a finger on such hand may be used to release a sear from engagement with the bowstring.

A need exists for an archery apparatus in which (1) the maximum draw weight is optimized for a given archer for any given bow (i.e., longbow, recurved or compound bow), (2) the arrow rest is positioned adjacent the bowstring in its rest position to allow the use of shorter arrows, (3) the arrow rest is retracted at the proper time to eliminate interference with the flight of the arrow and (4) any misalignment of the central section of the bow can be detected and corrected by the archer.

SUMMARY OF THE INVENTION

An archery apparatus in accordance with the present invention comprises a bow having a central section or riser and a pair of resilient limbs extending in opposite directions from the central section. A bowstring is connected between the ends of the limbs and includes a nocking point adapted to engage the nock on an arrow. An arrow rest is carried by the central section and lies in the plane of movement of the bowstring (i.e. central plane). The arrow rest together with the nocking point align the arrow on a shooting axis along which the arrow travels when departing the bow. At least one hand grip (and preferably two) is carried by the central section adjacent the shooting axis. Means such as a harness adapted to be worn by the archer includes a bowstring release mechanism. In operation the archer, after affixing the harness to his or her body, secures the bowstring to the bowstring release mechanism carried by the harness, flexes the bow limbs by forcing the bow central section away from the harness with one and preferably both arms and then activates the bowstring release mechanism to propel the arrow toward the desired target.

A preferred arrow rest in accordance with my invention includes a bracket having an upper surface adapted to support the shaft of the arrow and a lower end pivotally mounted on the central section of a bow. Means responsive to movement of the bowstring are provided to rotate the arrow rest away from the shooting axis when the bowstring is released. Where it is desired to shoot short arrows, the arrow rest bracket may be positioned adjacent the bowstring in its resting position and define an opening in the lower end thereof through which the bowstring may travel in reaching its post release position.

A torque or misalignment detection system in accordance with the invention includes a vertical cross-hair mounted on the central section of the bow in the central plane, a peep sight mounted on the bowstring and a pair of vertical anti-torque lines mounted on the central section on opposite sides of the central plane and between the bowstring and the bow sight so that the archer may align the bow to center the vertical cross-hair between the antitorque lines as viewed through the peep sight.

The features of this invention can best be understood from the following description taken in conjunction with the drawings wherein like reference numerals designate like components.

DESCRIPTION OF THE PREFERRED EMBODIMENT

Figure 2:
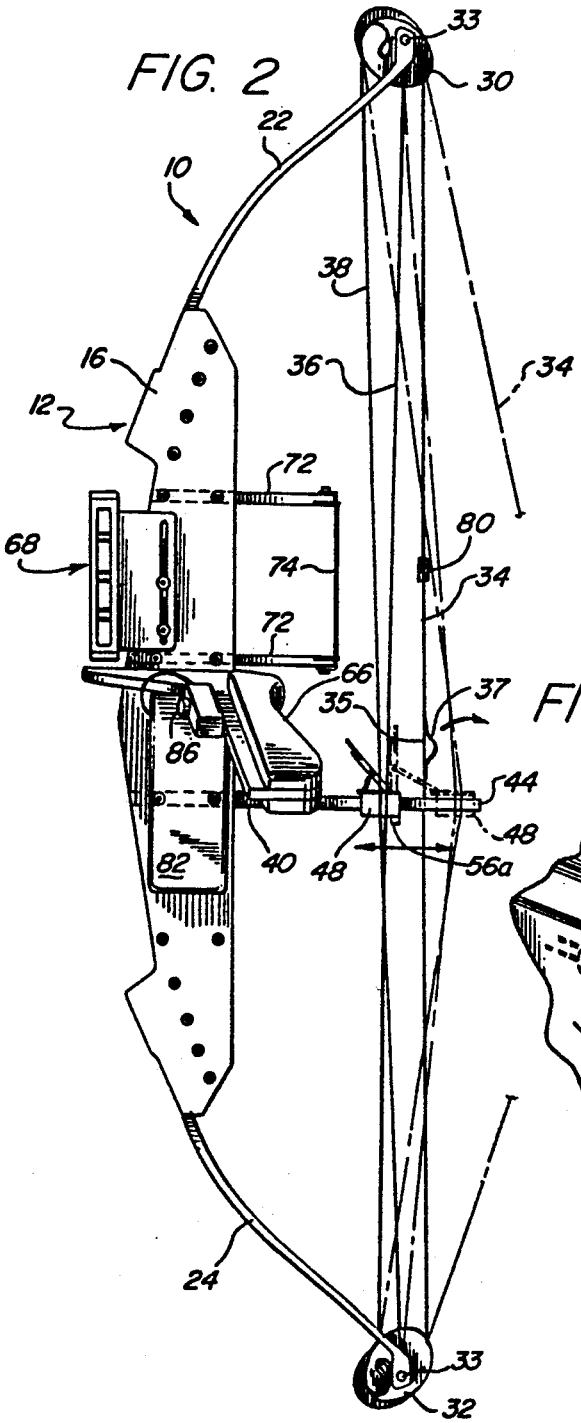
FIG. 2 is a side elevational view of the bow of FIG. 1.
Figure 1:
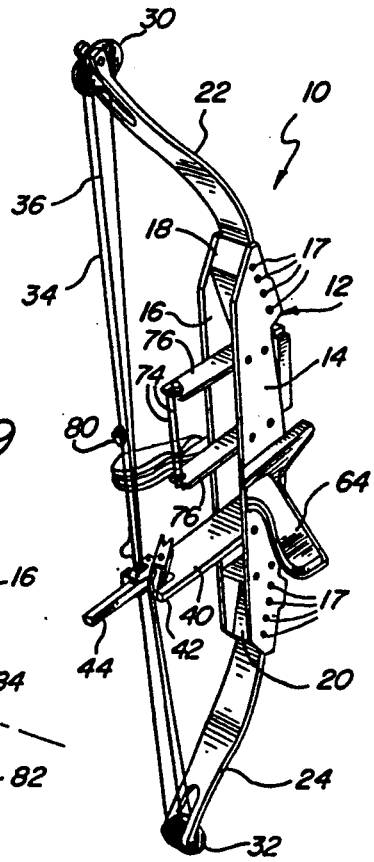
FIG. 1 is a perspective view of a bow in accordance with this invention.
Figure 9:
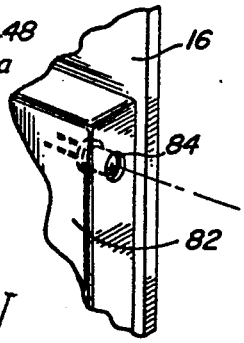
FIG. 9 is an enlarged fragmentary view of the arrow release signal transmitter carried by the bow illustrating the light emitting diode therein.

Referring now to the drawings and particularly to FIGS. 1–4, a compound bow 10 includes an elongated central section frame or riser 12. The frame 12 may be made of aluminum or other suitable material. The frame comprises a pair of side plates 14 and 16 which are secured together at their ends via bolts 17 through limb attachment blocks 18 and 20. Flexible limbs 22 and 24, made of conventional materials such as glass fibers and resin (e.g. Fiberglas ®), carbon or graphite composites, are secured to each end of the blocks 18 and 20 via bolts and adjustment nuts 26 and 28, respectively in a conventional manner. (Fiberglas is a trademark of Owens Corning). A fulcrum member (not shown) is positioned within each of the blocks 18 and 20 and engages the respective limb adjacent the end of the block to allow the tension on the limbs to be adjusted by the nuts 26 and 28 as is well known.

Conventional eccentric wheels or cammed pulleys 30 and 32 are rotatably mounted on the ends of the limbs 22 and 24, via shafts 33, respectively. A bowstring 34 has its ends connected to the pulleys as illustrated and includes a nocking point 35 adapted to engage the nock on an arrow. See FIG. 2. A short cord (or loop) 37 has its ends secured to the bowstring on each side of the nocking point and cooperates with a bowstring release mechanism to be described. The cord forms part of the bowstring. A pair of cables 36 and 38 have one end connected to a respective shaft 33 and the other end connected to a respective pulley. This arrangement is typical and provides the let-off inherent in compound bows as discussed earlier.

Figure 8:
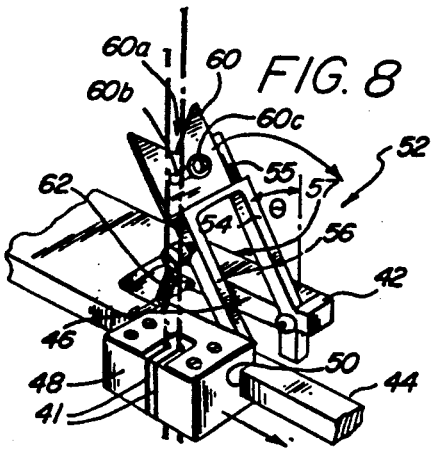
FIG. 8 is an enlarged fragmentary perspective view of the arrow rest bracket carried by the bow of FIG. 1.

A cable guard 40 in the form of an elongated plate is mounted on the frame 12 via suitable bolts and extends horizontally with respect to the vertically oriented frame 12. The cable guard 40 has a forked end adjacent the bowstring with a pair of legs 42 and 44 extending on each side of a U-shaped opening 46 which opening is centered about the plane of movement of the bowstring, (hereinafter referred to as the "central plane"). A cable guide 48 having a channel 50 on one side thereof is slidably mounted on the leg 44 of the cable guard as is illustrated in FIG. 8. The mid-sections of cables 36 and 38 are secured to the cable guide 40 via grooves 41. The cable guide holds the cables to one side of the central plane so that the cables will not interfere with the path of the arrow shaft and its vanes.

An arrow rest 52 in the form of a U-shaped bracket with downwardly depending legs 54 and 56 and an upwardly extending plate 60 with a V-notch **60*a* therein is provided to support the shaft of the arrow. The lower ends of the legs are pivotally mounted on the inside of the cable guard legs 42 and 44 as shown and defines a U-shaped opening 57** for accommodating the bowstring in its post release position as will be explained.

The terminal end of leg 56 includes an outwardly projecting shoulder **56*a* which engages the underside of the cable guard leg 44 when the arrow rest is pivoted upwardly and prevents the rest from being rotated beyond the vertical position. The shoulder 56*a* also engages the leg 44 when the arrow is pivoted downwardly to stop the rest from moving beyond an angle $\theta$ within the range of about 20° to 90° to the vertical position and preferably about 45°. See FIG. 2. The upper plate 60 of the arrow rest includes a slot 60*b* through which a bolt 60*c* is inserted. The bolt 60*c* is threaded into the upper extension 55 of the U-shaped bracket (54,56) to allow the plate 60 and the notch 60*a*** to be aligned with the central plane.

A spring 62 is connected between the arrow rest bracket leg 56 and the cable guide 48 as illustrated so that the position of the arrow rest is controlled by the movement of the cable guide which in turn is controlled by the movement of the cables 36,38 and the bowstring 34.

When the bowstring is in its full draw position, the cable guide is positioned toward the end of the cable guard leg 44 and pulls the arrow rest to its vertical position via spring 62 (as is illustrated by the phantom lines in FIG. 2). In this position the arrow is aligned along the shooting axis. When the bowstring is released the cables and cable guide move toward the frame 12 until the post release position is reached and the arrow rest is retracted to its fully retracted position (via the spring 62), which position it also assumes when the bowstring is at rest.

Figure 4:
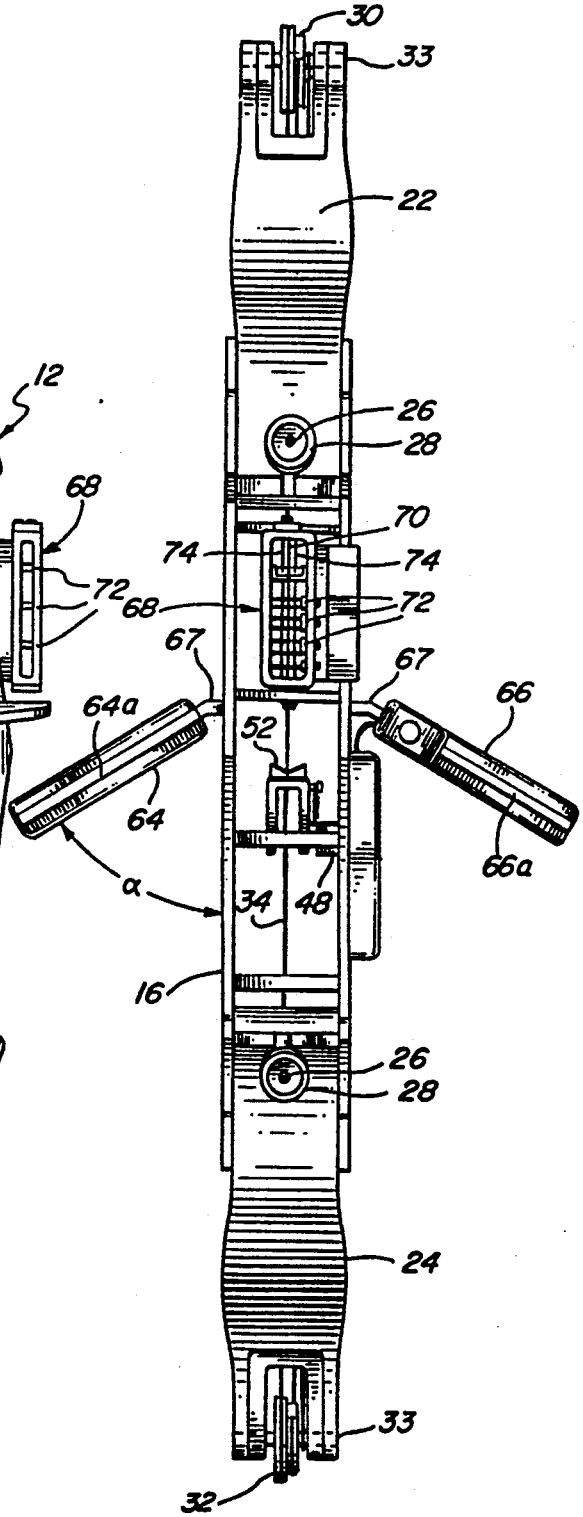
FIG. 4 is a front elevational view of the bow.

A pair of downwardly extending hand grips 64 and 66 are mounted on the frame 12 on opposite sides of the central plane via angle plates 67 and suitable bolts (not shown) so that the archer can apply force to the central section of the bow with both arms to move the bowstring to its full draw position as will be explained more fully. The hand grips are preferably positioned at an angle $\propto$ to the central plane within the range of 30° to 60° and most preferably at about 45°. The centers **64*a* and 66*a*** of the hand grips preferably lie in a plane which encompasses the shooting axis and is perpendicular to the central plane as is illustrated in FIG. 4. This arrangement allows the archer to apply the draw weight force directly in line with the shooting axis.

Figure 3:
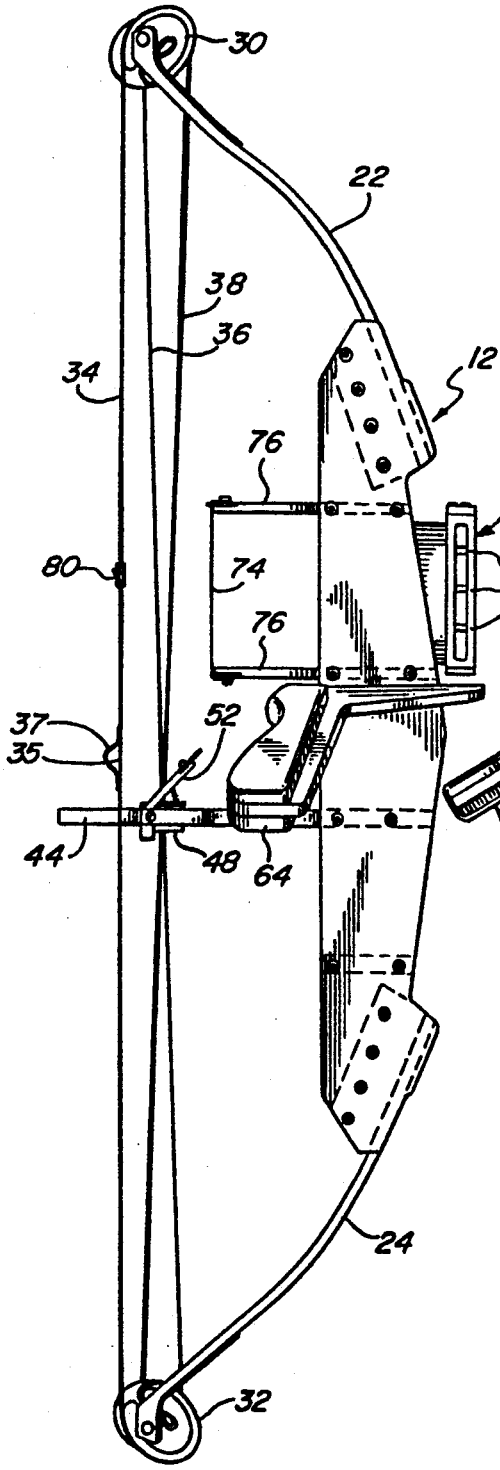
FIG. 3 is an elevational view of the bow on the opposite side to that shown in FIG. 2.

A bow sight 68 is mounted on the front of the frame 12 and includes a vertical cross-hair 70 (parallel to the bowstring) aligned with the central plane as well as horizontally oriented range lines 72 as is best illustrated in FIGS. 2–4.

A pair of vertically oriented antitorque sighting lines 74 are mounted on rearwardly extending horizontal brackets 76 (bolted to the frame 14). The antitorque lines are positioned on opposite sides of the central plane and between the bowstring and the bowsight. Preferably the lines are spaced about ¼ to ½ inches apart and positioned about 4 to 12 inches from the bowsight.

A conventional peep sight 80 is carried by the bowstring so that when the bowstring is at its full draw position the archer can by looking through the peep sight position the frame 12 so that the antitorque lines 74 frame the vertical cross-hair 70 and the target to allow the archer to eliminate any twisting of the bow.

A bowstring release signal generating and transmitting unit 82 is also mounted on the frame 12 and includes a light transmitting diode 84 for transmitting a light signal toward the rear of the bow. A manually operated switch 86 (FIG. 4) is mounted adjacent the grip 66 to enable the archer to activate the transmitter as will be explained in more detail.

Figure 5:
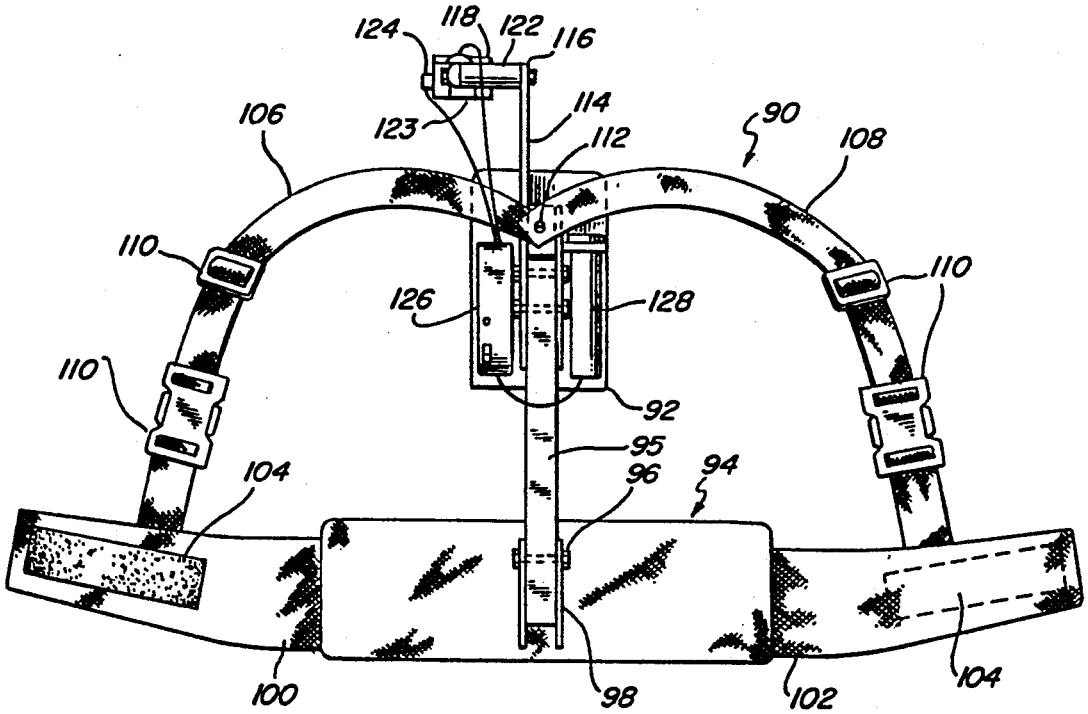
FIG. 5 is a rear elevational view of a harness assembly in accordance with the invention.

Referring now to FIG. 5, a harness assembly 90 includes a rigid back plate 92 pivotally connected to a flexible belt or strap 94 via a bar 95, a bolt 96 and rigid channel bracket 98. The belt 94 includes extended arm portions 100 and 102 which are arranged to wrap around the archer's waist and be releasably secured together by a suitable fastener such as velcro strips 104. Shoulder straps 106 and 108, provided with adjustable buckles 110, are suitably secured to the belt extensions 100 and 102 (e.g. by sewing) and the back plate via a rivet 112. The back plate 92 may be curved to conform to the archer's back and padded for the comfort.

An L-shaped extension bar 114 is bolted to the pivoted bar 95 adjacent the back plate 92. A bowstring release mechanism 118 for holding the bowstring in the full draw position is secured to the upper end of the bar 114 via a horizontally oriented arm 122 and horizontally oriented bracket 123. An optic detector 124 in the form of a light sensitive solid state device (forming part of the receiver) is mounted on one side of the bowstring release mechanism 118 for sensing the bowstring release signal from the transmitter carried on the bow. The output of the optic detector is supplied to an electronic circuit module 126 (mounted on back plate 92) which activates the bowstring release mechanism. A battery 128 is also carried on the back plate 92 for supplying power to the receiver. The transmitter and receiver circuits are described in more detail in conjunction with FIGS. 11 and 12.

Figure 6:
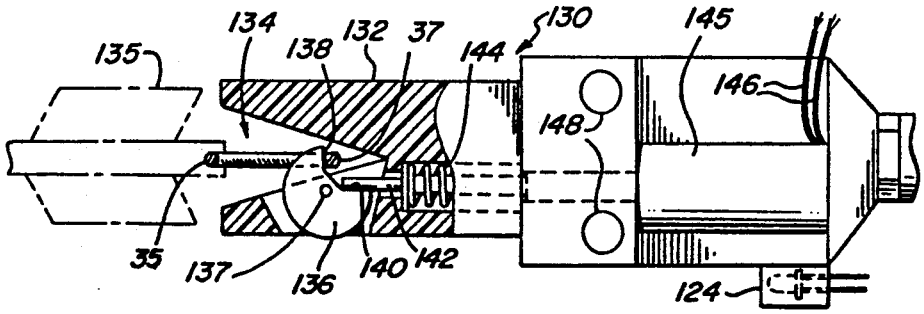
FIG. 6 is a enlarged plan view partially broken away of the arrow release mechanism carried by the harness in FIG. 3 showing the bowstring retaining position.
Figure 7:
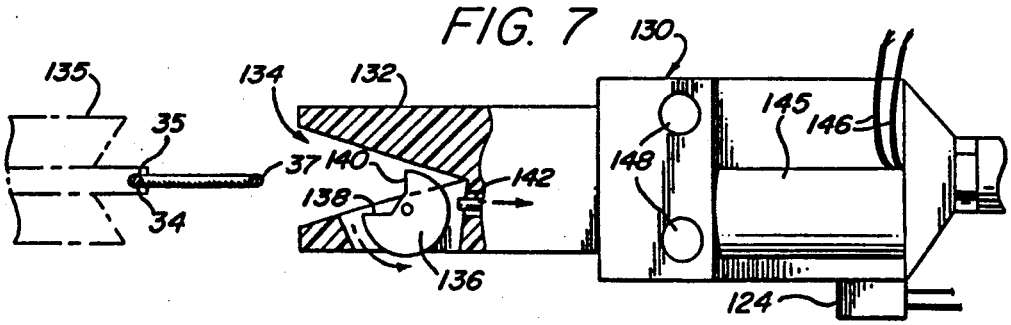
FIG. 7 is another enlarged plan view partially broken away of the release mechanism showing the bowstring release position.

A bowstring release mechanism is illustrated in FIGS. 6 and 7. The mechanism comprises a body 130 having a cylindrical front section 132 with a V-shaped opening 134 therein for receiving the cord or loop 37 of the bowstring 34. A sear 136 in the form of a notched cylindrical plate is rotatably mounted on pin 137 in the front section 132 and protrudes into the opening 134 as illustrated. The sear includes a bowstring griping or retaining surface 138 which engages the bowstring loop 37 and a latching surface 140 which engages a plunger 142. The plunger 142 is biased by a spring 144 against the sear 136 and prevents rotation thereof in the bowstring retaining position as is illustrated in FIG. 6. The sear 136 extends beyond the outer surface of the cylindrical section 132 so that it may be manually rotated from the release position of FIG. 7 (after the cord 37 is inserted into the opening 134) to its retention position of FIG. 6.

A solenoid 145 is mounted on the body 130 and when actuated by an electrical actuating signal applied to conductors 146 withdraws the plunger from the sear and allows the sear to rotate to the bowstring release position illustrated in FIG. 7. The body 130 is retained on the bracket 123 by a pair of cylindrical bores 148 which slide over cooperating posts (not shown) on the bracket 123. The optic detector 124 is mounted on the body 130 by suitable means such as metal screws.

Manually operated bowstring release mechanisms similar to that illustrated in FIGS. 6 and 7 (without a solenoid or other electrically operating means) have been used with conventional bows prior to my invention.

Figure 10:
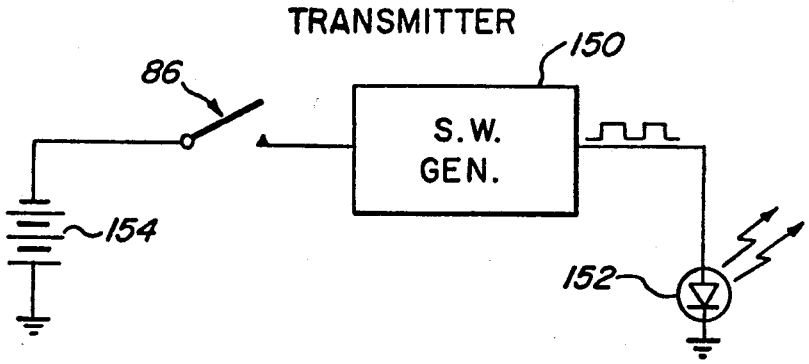
FIG. 10 is a block diagram of a transmitter circuit carried by the bow of FIG. 1 for generating a bow release signal.
Figure 11:
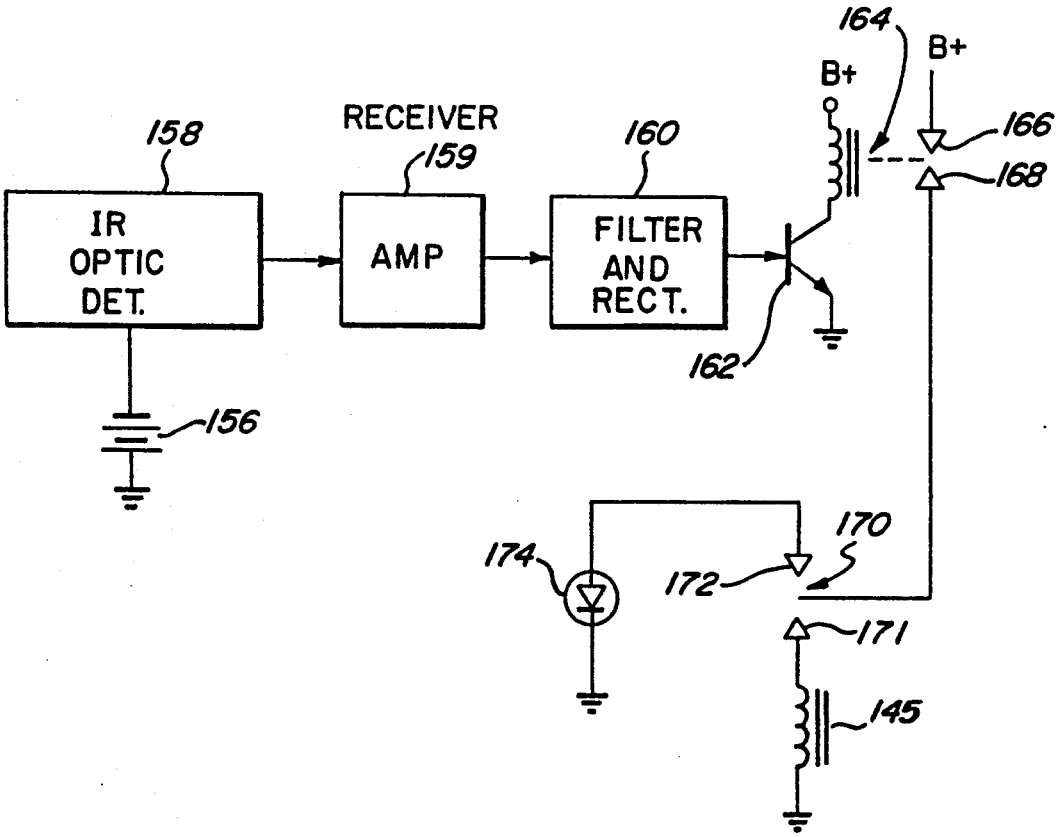
FIG. 11 is a block diagram of a receiver circuit carried by the harness assembly of FIG. 5 for sensing the transmitted bowstring release signal and actuating the bowstring release mechanism.

A bowstring release signal transmitter and receiver are illustrated in FIGS. 10 and 11. The transmitter includes a square wave generator 150 for generating a high frequency signal (e.g. 40 KHz), a light emitting diode 152, the switch 86 and a battery 154 as is shown in FIG. 10. The receiver includes a battery 156, a light detector 158 (preferably sensitive to infrared) and an amplifier 159. The output of the amplifier is applied to a bandpass filter and rectifier circuit 160 which applies an output signal to operate a switch such as transistor 162. The switch 162 in turn operates a relay 164 from the battery (designated B+). The relay when activated closes contacts 166 and 168 to supply current from the B+ supply to a manually operated single pole single throw switch 170. When, the switch 170 is operated to make contacts 172 and 171, a light emitting diode 174 informs the archer that the transmitter and receiver are operating properly. When the switch is operated to make contacts 171 and 172 and the relay 164 operated (i.e. in response to the bowstring release signal from the transmitter) the bowstring release solenoid 144 is actuated to release the bowstring.

Figure 12:
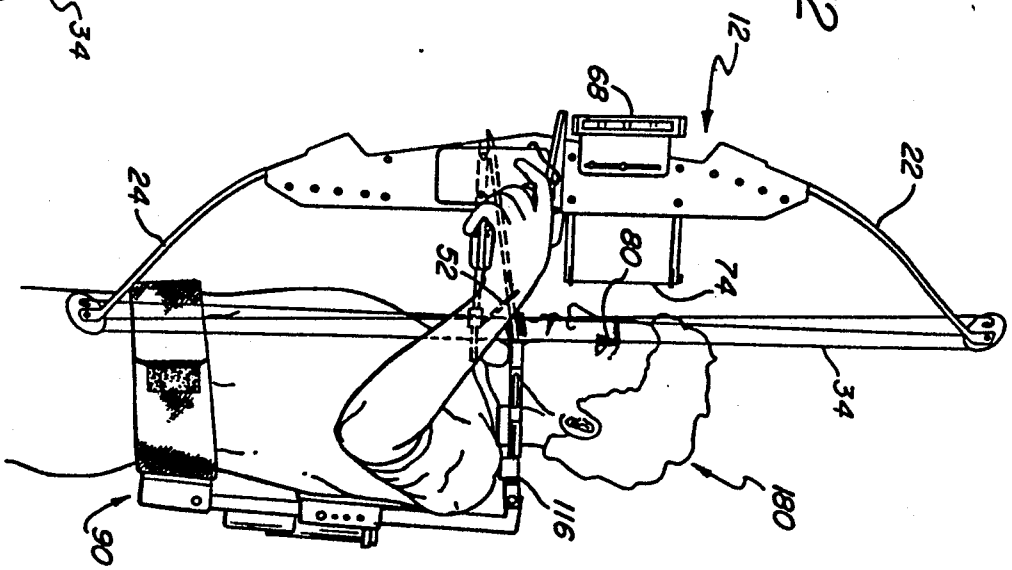
FIG. 12 is a side elevational view of the bow held by an archer in the at rest position with the harness assembly strapped to the archer's body.
Figure 13:
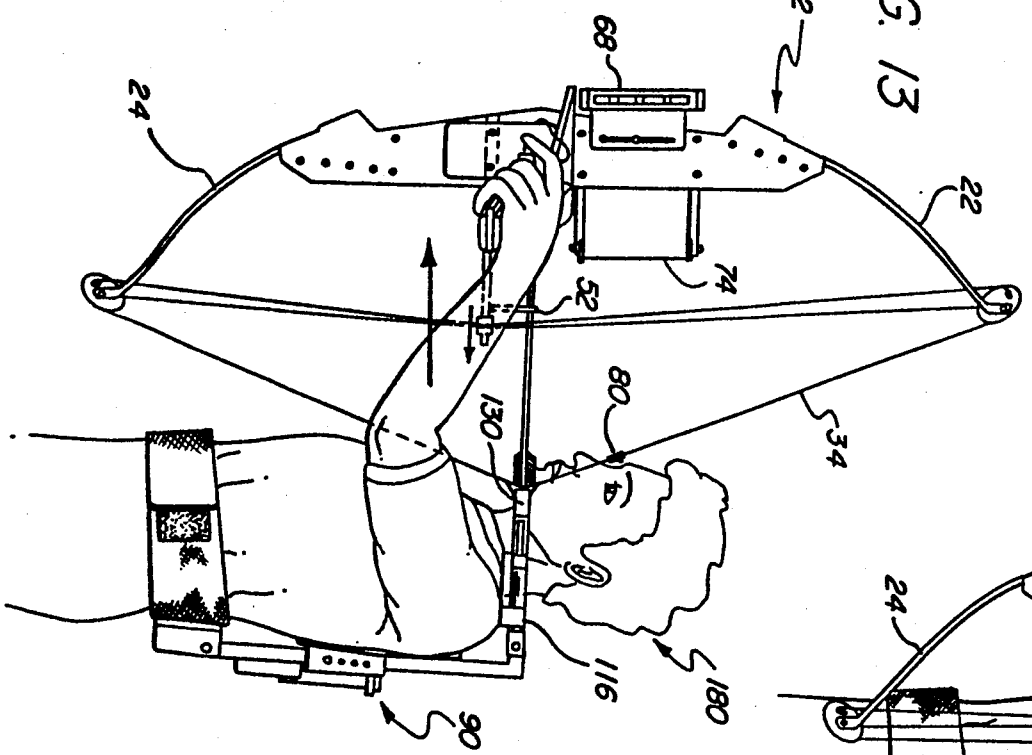
FIG. 13 is a side elevational view similar to FIG. 13 showing the archer pushing the bow away from the harness toward the full draw position.

The operation of the archery apparatus of FIGS. 1–11 will now be explained in reference to FIGS. 12 and 13. Initially the archer (designated 180) straps the harness 90 around his or her body or torso so that the back plate is positioned along the upper back and the bowstring release mechanism 130 positioned over one shoulder and adjacent the neck. It should be noted that the shoulder straps are not shown in FIGS. 12 and 13.

The archer after confirming that the sear 136 of the bowstring release mechanism is in its release position as illustrated in FIG. 7 (manually rotating the sear while switch 86 is pressed if necessary) positions the bow adjacent the harness and inserts the bowstring cord or loop into the opening 134 and turns the sear to its retention position as is illustrated in FIG. 6. The archer, after placing an arrow on the arrow rest 52 and the bowstring, places both hands on the hand grips and pushes the bow away from the body and harness with both arms as is illustrated in FIG. 13. This action caused the cables 36 and 38 and the cable guide 52 to move rearwardly as the bow limbs arch. The rearward movement of the cable guide moves the spring 62 to the bowstring side of the arrow rest and pulls the arrow rest into a vertical position so that the arrow is aligned along the shooting axis. With the bowstring in its full draw position the archer aligns the bow until the vertical crosshair 70 is centered between the antitorque lines 74 and in line with a desired target as viewed through the peep sight. The switch 86 is then actuated which causes the transmitter via the light emitting diode 84 to transmit a bowstring release signal (i.e. square wave light signal) toward the optic detector 124 on the harness. The receiver detects the bowstring release signal and applies an actuating signal to solenoid 145 which withdraws the plunger 142 and allows the sear 136 to release the bowstring. Upon release the bowstring accelerates the arrow to a velocity which may be double the velocity achievable with prior art compound bows. During the release operation the bowstring moves toward the frame 12 and the mid-sections of the cables 36 and 38 slide the cable guide 48 along the cable guard causing the spring 62 to pivot the U-shaped bracket counterclockwise (as viewed in FIG. 9) to thereby retract the arrow rest from the path of the vanes on the back of the arrow. In its post release position the bowstring travels forwardly beyond its resting position and enters the opening 57 in the arrow rest bracket 54. The bow may now be prepared to shoot another arrow.

A bow in accordance with my invention may be designed for considerably higher draw weights because both of the archer's arms and body are used to force the bowstring to its full draw position. For example, maximum peak draw weights with compound bows of the order 200 or more pounds with a 50–65% let-off are achievable with my invention as contrasted to peak draw weights of 50 to 80 pounds with conventional adult compound bows. The exit velocity of an arrow can be increased by 50% to 100% with the use of my invention over the use of conventional bows. In shooting a conventional bow an archer utilizes the upper back muscles (of one arm) in a pulling action. An archer shooting my bow utilizes the tricep muscles in both arms as well as the major pectoral and back muscles in a pushing action (e.g. similar to a weight lifting bench press action).

The retractable arrow rest allows the use of shorter arrows (i.e. of the order of 15" to 18" in length) as contrasted with conventional arrows (i.e. 24"-32" in length). Shorter arrows can be designed to be lighter and stiffer than the longer arrows thereby improving their trajectory and range.

There has been described an archery apparatus which provides a significant improvement in the trajectory, range, destructive power and accuracy of the arrow. Various modifications to the described apparatus will be apparent to those skilled in the art without involving any departure from the spirit and scope of my invention as defined in the appended claims.

What is claimed is:

1. An archery apparatus for launching arrows comprising:

a bow having:

a central section;

a pair of resilient limbs extending in opposite directions from the central section;

a bowstring connected between the ends of the limbs and having a nocking point, the bowstring, limbs and central section lying generally in a central plane encompassing the path of the arrow to be launched;

an arrow rest disposed in said central plane for supporting the shaft of the arrow, the arrow rest and nocking point aligning the arrow on a shooting axis along which the arrow travels when departing the bow;

at least one hand grip extending from the central section adjacent the shooting axis; and a harness assembly adapted to be worn by the archer free of the archer's hands and arms and having means for selectively holding and releasing the bowstring adjacent the nocking point, whereby the archer may secure the bowstring to the bowstring releasing means on the harness, flex the bow limbs by forcing the central section of the bow away from the harness with at least one arm and then actuate the bowstring releasing means to propel an arrow toward a desired target.

2. The archery apparatus of claim 1 wherein said at least one hand grip comprises two hand grips disposed on opposite sides of the central plane whereby both arms may be used to force the central section of the bow away from the harness.

3. The archery apparatus of claim 2 wherein the approximate center portions of the hand grips are aligned in a plane encompassing the shooting axis and perpendicular to the central plane.

4. The archery apparatus of claim 2 wherein the bow is arranged to shoot arrows with flight stabilizing vanes and wherein the arrow rest is positioned adjacent the bowstring in its rest position and wherein the bow further includes means for retracting the arrow rest away from the shooting axis when the bowstring is released from its full draw position to prevent the arrow rest from contacting the vanes on the arrow during its acceleration toward the target.

5. The archery apparatus of claim 4 wherein the arrow rest comprises a bracket having an upper shaft engaging surface for supporting the shaft of the arrow and a lower end pivotally mounted to the central section.

6. The archery apparatus of claim 5 wherein the arrow rest defines a generally U-shaped opening extending below the shaft engaging surface and straddling the bowstring in its post release position when the arrow rest is in its retracted position.

7. The archery apparatus of claim 5 wherein the bow further includes:

a pair of cables connected between the ends of the limbs, the cables serving to increase the energy stored in the limbs when the bowstring is moved to its full draw position and allow that energy to be imparted to the arrow when the bowstring is released from its full draw position, in response to movement of the bowstring;

a cable guard secured to the central section and extending rearwardly of the central section and generally parallel to the shooting axis;

a cable guide secured to the cables and arranged to slidably engage the cable guard; and wherein the arrow rest retracting means includes means coupling the arrow rest to the cable guide so that movement of the cable guide retracts the arrow rest from the shooting axis.

8. The archery apparatus of claim 7 wherein the lower end of the arrow rest is positioned rearwardly of the post release position of the bowstring and includes an open area in the retracted position for accommodating the bowstring in its post release position.

9. The archery apparatus of claim 8 wherein the lower end of the arrow rest defines a generally U-shaped opening extending below the shaft engaging surface which straddles the bowstring in its post release position.

10. The archery apparatus of claim 7 wherein the lower end of the arrow rest bracket is pivotally mounted on the cable guard and arranged to assume a vertical position when the bowstring is in its full draw position and an angle to said vertical position within the range of 20° to 90° when the bowstring is in its post release position and further wherein the coupling means between the arrow rest bracket and the cable guide comprises a spring.

11. The archery apparatus of claim 2 wherein the bowstring releasing means includes a bowstring engaging member and wherein the harness is constructed and arranged to position the bowstring engaging member adjacent one shoulder and the neck of the archer.

12. The archery apparatus of claim 11 wherein the bowstring releasing means includes a manually actuated release switch disposed adjacent one of the hand grips, a transmitter carried by the central section for transmitting a release signal in response to the actuation of the release switch and a receiver carried by the harness and coupled to the bowstring engaging member, the receiver being arranged to operate the bowstring engaging member to release the bowstring in response to the release signal.

13. The archery apparatus of claim 12 wherein the release signal is a light signal.

14. The archery apparatus of claim 13 wherein the transmitter includes a light emitting diode, the light emitting diode being energized in response to the actuation of the release switch and wherein the receiver includes a light sensitive semiconductor element.

15. The archery apparatus of claim 2 further including a bow sight mounted on the central section and including a vertical cross-hair aligned with the central plane, a pair of antitorque lines mounted on the central bow section rearwardly of the bow sight and on opposite sides of the central plane, and a peep sight mounted on the bowstring whereby the archer may align the bow to center the vertical cross-hair of the bow sight between the antitorque lines as viewed through the peep sight to maintain the central plane of the bow in alignment with the desired target.

16. An archery apparatus comprising:

an elongated frame having limb mounting means at each end thereof and an arrow receiving opening therein;

a pair of resilient limb members, each limb member having one end thereof, secured on a respective limb mounting means of the frame and a free end remote from the frame;

a bowstring connected between the free ends of the limb members and having a nocking point for engagement with the nock of an arrow;

a hand grip mounted on each side of the frame adjacent the arrow receiving opening, said hand grips each having one end mounted to said frame and an elongated gripping portion extending outwardly from said frame, said handgrips providing means for simultaneously accommodating both hands of the archer; and means adapted to be worn by the archer and having bowstring releasing means for selectively holding and releasing the bowstring adjacent the nocking point.

17. The archery apparatus of claim 16 wherein the bowstring releasing means includes a harness having a back plate adapted to rest against the archer's back and straps for releasably securing the back plate to the archer.

18. The archery apparatus of claim 17 wherein the bowstring releasing means further includes a body and a bowstring gripping means pivotally mounted on the body for movement between a retaining position in which the gripping means engages the bowstring and a release position in which the gripping means disengages the bowstring and a bracket mounting the gripping means to the back plate to position the gripping means adjacent the shoulder and neck of the archer.

19. The archery apparatus of claim 18 wherein the bowstring releasing means further includes means for actuating the gripping means to disengage the bowstring in response to an electrical actuating signal and further including a transmitter and manually operated switch mounted on the frame adjacent one of said hand grips for generating and transmitting a bowstring release signal and a receiver mounted on the harness for receiving the bowstring release signal and supplying said electrical actuating signal to said bowstring gripping means.

20. The archery apparatus of claim 17 wherein the bow is arranged to shoot arrows with flight stabilizing vanes and wherein the arrow rest is positioned adjacent the bowstring in its rest position and wherein the bow further includes means for retracting the arrow rest away from the shooting axis when the bowstring is released from its full draw position to prevent the arrow rest from contacting the vanes on the arrow during its acceleration toward the target.

21. The archery apparatus of claim 20 wherein the arrow rest comprises a bracket having an upper shaft engaging surface for supporting the shaft of the arrow and a lower end pivotally mounted to the central section.

22. The archery apparatus of claim 21 wherein the arrow rest defines a generally U-shaped opening extending below the shaft engaging surface and straddling the bowstring in its post release position when the arrow rest is in its retracted position.

23. The archery apparatus of claim 22 wherein the bow further includes:

a pair of cables connected between the free ends of the limbs, the cables serving to increase the energy stored in the limbs when the bowstring is moved to its full draw position and allow that energy to be imparted to the arrow when the bowstring is released from its full draw position, in response to movement of the bowstring;

a cable guard secure to the central section and extending rearwardly of the central section and generally parallel to the shooting axis;

a cable guide secured to the cables and arranged to slidably engage the cable guard; and wherein the arrow rest retracting means includes means coupling the arrow rest to the cable guide so that movement of the cable guide retracts the arrow rest from the shooting axis.

24. The archery apparatus of claim 17 further including a bow sight mounted on the central section and including a vertical cross-hair aligned with the central plane, a pair of antitorque lines mounted on the central bow section rearwardly of the bow sight and on opposite sides of the central plane, and a peep sight mounted on the bowstring whereby the archer may align the bow to center the vertical cross-hair of the bow sight between the antitorque lines as viewed through the peep sight to maintain the central plane of the bow in alignment with the desired target.

25. A bow for shooting arrows with flight stabilizing vanes comprising:

a central section;

a pair of resilient limbs extending in opposite directions from the central section;

a bowstring connected between the ends of the limbs and having a nocking point, the bowstring, limbs and central section lying generally in a central plane encompassing the path of movement of the bowstring in launching an arrow, said bowstring moving to a post release position after being released;

an arrow rest mounted to said central section and having a shaft engaging surface positioned rearwardly of the bowstring post release position for supporting the shaft of the arrow, the arrow rest shaft engaging surface and nocking point aligning the arrow on a shooting axis along which the arrow travels when departing the bow; and arrow rest retracting means coupled to the arrow rest and responsive to movement of the bowstring for retracting the arrow rest shaft engaging surface away from the shooting axis when the bowstring is released from its full draw position and before the vanes on the arrow travel past the shaft engaging surface to prevent the arrow rest from contacting the vanes on the arrow during its acceleration toward the target, the arrow rest defining an opening extending below the shaft engaging surface for receiving the bowstring in its post release position.

26. The archery apparatus of claim 25 wherein the arrow rest comprises a bracket having an upper shaft engaging surface for supporting the shaft of the arrow and a lower end pivotally mounted to the central section.

27. The archery apparatus of claim 26 wherein the arrow rest defines a generally U-shaped opening extending below the shaft engaging surface and straddling the bowstring in its post release position when the arrow rest is in its retracted position.

28. The archery apparatus of claim 27 wherein the bow further includes:

a pair of cables connected between the ends of the limbs, the cables serving to increase the energy stored in the limbs when the bowstring is moved to its full draw position and allow that energy to be imparted to the arrow when the bowstring is released from its full draw position, in response to movement of the bowstring;

a cable guard secured to the central section and extending rearwardly of the central section and generally parallel to the shooting axis;

a cable guide secured to the cables and arranged to slidably engage the cable guard; and wherein the arrow rest retracting means includes means coupling the arrow rest to the cable guide so that movement of the cable guide retracts the arrow rest from the shooting axis.

29. The archery apparatus of claim 28 wherein the lower end of the arrow rest bracket is pivotally mounted on the cable guard and arranged to assume a vertical position when the bowstring is in its full draw position and an angle to said vertical position within the range of 20° to 90° when the bowstring is in its post release position and further wherein the coupling means between the arrow rest bracket and the cable guide comprises a spring.

30. A bow comprising:

a central section;

a pair of resilient limbs extending in opposite directions from the central section;

a bowstring connected between the ends of the limbs and having a nocking point, the bowstring, limbs and central section lying generally in a central plane encompassing the path of the arrow to be launched;

an arrow rest disposed in said central plane for supporting the shaft of the arrow, the arrow rest and nocking point aligning the arrow on a shooting axis along which the arrow travels when departing the bow; and a pair of hand grips mounted on the central section on opposite sides of the central plane, said hand grips each having one end mounted to the central section and an elongated gripping portion extending outwardly from said central plane, said handgrips providing means for simultaneously accommodating both hands of the archer.

31. The bow of claim 30 wherein each of the hand grips includes a central portion adapted to be centered in the archer's hand, the central portions intersect a plane which encompasses the shooting axis and which is perpendicular to the central plane.

32. The bow of claim 31 wherein the hand grips are mounted at one end on the central section and extend downwardly therefrom at an acute angle within the range of about 30° to 60°.

33. The bow of claim 32 wherein said acute angle is about 45°.

34. An archery apparatus for launching arrows comprising:

a bow having:

a central section;

a pair of resilient limbs extending in opposite directions from the central section;

a bowstring connected between the ends of the limbs and having a nocking point, the bowstring, limbs and central section lying generally in a central plane encompassing the path of the arrow to be launched;

an arrow rest disposed in said central plane for supporting the shaft of the arrow, the arrow rest and nocking point aligning the arrow on a shooting axis along which the arrow travels when departing the bow;

at least one hand grip extending from the central section adjacent the shooting axis; and a harness assembly adapted to be worn on the torso of the archer and having means for selectively holding the bowstring adjacent the nocking point, whereby the archer may secure the bowstring to the bowstring holding means on the harness, flex the bow limbs by forcing the central section of the bow away from the harness with at least one arm and then release the bowstring to propel an arrow toward a desired target.

35. The archery apparatus of claim 34 wherein said at least one hand grip comprises two hand grips disposed on opposite sides of the central plane whereby both arms may be used to force the central section of the bow away from the harness.

36. The archery apparatus of claim 35 wherein the bowstring holding means further includes means for releasing the bowstring.

37. The archery apparatus of claim 35 wherein the harness includes a backplate adapted to rest against the archer's back and straps for releasably securing the backplate to the archer's torso.

38. A bow for shooting arrows with flight stabilizing vanes comprising:

a central section;

a pair of resilient limbs extending in opposite directions from the central section;

a bowstring connected between the ends of the limbs and having a nocking point, the bowstring, limbs and central section lying generally in a central plane encompassing the path of movement of the bowstring in launching an arrow;

a pair of cables connected between the ends of the limbs, the cables serving to increase the energy stored in the limbs when the bowstring is moved to its full draw position and allow that energy to be imparted to the arrow when the bowstring is released from its full draw position, in response to movement of the bowstring;

a cable guard secured to the central section and extending rearwardly of the central section and generally parallel to the shooting axis;

a cable guide secured to the cables and arranged to slidably engage the cable guard;

an arrow rest mounted to said central section for supporting the shaft of the arrow, the arrow rest and nocking point aligning the arrow on a shooting axis along which the arrow travels when departing the bow; and arrow rest retracting means coupled to the cable guide and responsive to movement of the cable guide for retracting the arrow rest away from the shooting axis when the bowstring is released from its full draw position to prevent the arrow rest from contacting the vanes on the arrow during its acceleration toward the target.

* * * * *